United States Patent [19]

Maxwell

[11] 4,388,253

[45] Jun. 14, 1983

[54] LIQUID COLLECTING AND DISPENSING APPARATUS

[76] Inventor: Thomas J. Maxwell, 14817 N. 50th Pl., Scottsdale, Ariz. 85254

[21] Appl. No.: 329,285

[22] Filed: Dec. 10, 1981

[51] Int. Cl.[3] ..... F02M 17/16

[52] U.S. Cl. ..... 261/88; 239/223; 239/458

[58] Field of Search ..... 239/458, 457, 223, 456; 261/88

[56] References Cited

U.S. PATENT DOCUMENTS

| | | | |
|---|---|---|---|
| 926,300 | 6/1909 | Stubbers | 239/456 |
| 1,024,261 | 4/1912 | Huston | 239/458 |
| 1,362,302 | 12/1920 | Hansen et al. | 261/88 |
| 1,719,869 | 7/1929 | Boyd | 261/88 |
| 1,760,903 | 6/1930 | Henkel | 239/458 |
| 1,893,212 | 1/1933 | Veenschoten | 239/457 |
| 2,805,844 | 9/1957 | McMaster | 261/88 |
| 2,991,016 | 7/1961 | Allenbaugh, Jr. | 239/456 |
| 3,044,441 | 7/1962 | Blakeslee et al. | 239/456 |
| 3,456,659 | 7/1969 | Tiby | 261/88 |
| 3,468,614 | 9/1969 | Nilsson | 239/223 |
| 3,873,026 | 3/1975 | Ochs | 239/240 |
| 3,991,143 | 11/1976 | Carter | 261/88 |
| 3,991,144 | 11/1976 | Diener | 261/88 |
| 4,119,275 | 10/1978 | Hunter | 239/456 |

FOREIGN PATENT DOCUMENTS

| | | | |
|---|---|---|---|
| 2855906 | 7/1980 | Fed. Rep. of Germany | 239/458 |
| 101883 | 10/1923 | Switzerland | 239/457 |
| 242598 | 10/1946 | Switzerland | 239/223 |
| 120406 | 9/1918 | United Kingdom | 239/458 |
| 714113 | 2/1980 | U.S.S.R. | 239/223 |

*Primary Examiner*—Tim R. Miles

*Attorney, Agent, or Firm*—Don J. Flickinger

[57] ABSTRACT

A pair of half sections forming a hollow chamber with one of the half sections being integrally connected with a rotatable shaft. The shaft includes a passageway through which liquid is inputted to the hollow chamber. One of the half sections is adjustably disposed within the other section thereby forming a variable length valve collar therebetween. A plurality of apertures are formed about the valve collar wherein the effective size of each aperture is varied as the two sections are selectively adjusted with respect to each other to thereby meter the amount of outflow of liquid from the chamber.

7 Claims, 11 Drawing Figures

FIG. 1
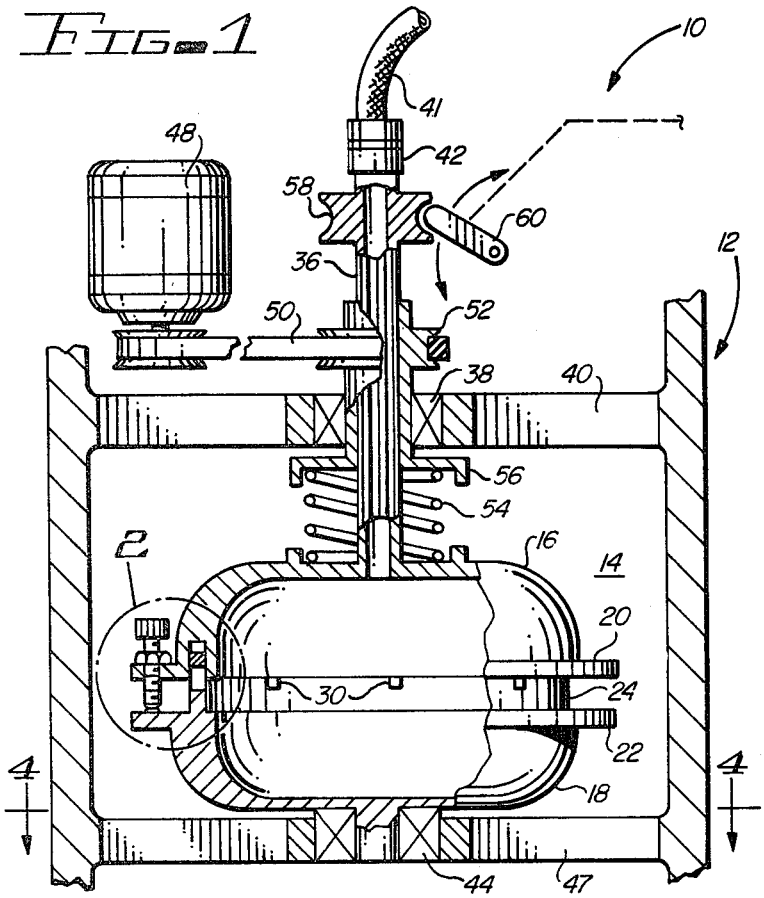
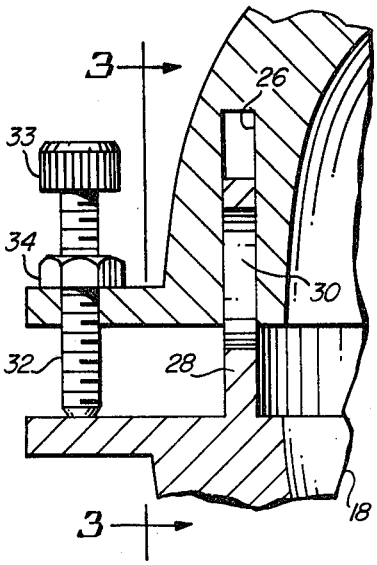
FIG. 2
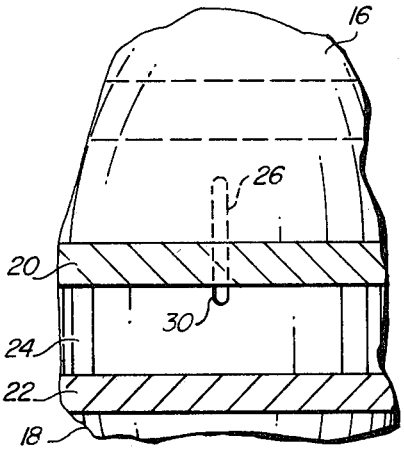
FIG. 3
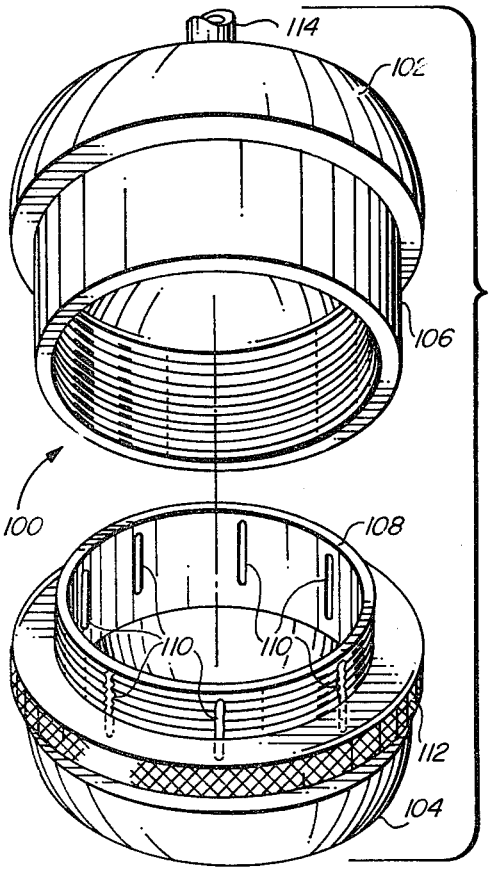
FIG. 5
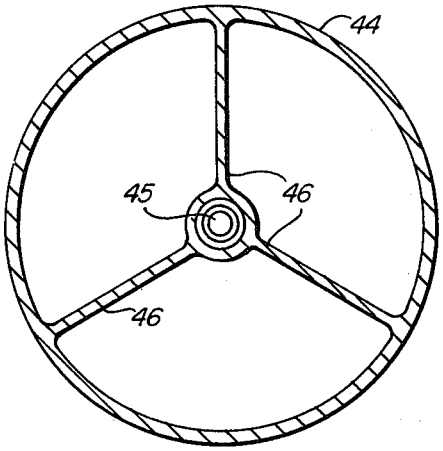
FIG. 4

LIQUID COLLECTING AND DISPENSING APPARATUS

BACKGROUND OF THE INVENTION

1. Field of the Invention

This invention relates to an apparatus for collecting and then dispensing a liquid. More particularly, the present invention pertains to an apparatus for collecting, mixing, and metering the discharge of a liquid supplied thereto.

2. Prior Art

There are many uses for an apparatus which is suited for receiving a fluid and discharging the same wherein the amount of fluid discharged can be accurately metered. For example, one such application may be a simple lawn sprinkler where, for accurate lawn soaking, it is desired to have a known amount of water metered over a predetermined surface area.

Another example of a use of such a liquid dispensing apparatus is as a carburetor for supplying an internal combustion engine with atomized and vaporized fuel mixed with air in an explosive mixture.

The structure of the basic carburetor has not changed much over the years since its introduction. The basic carburetor consists of an air inlet and a Venturi tube, or throat, leading from the atmosphere to the engine. As the air passes through the Venturi throat, it is speeded up, causing the static pressure of the air to be reduced below the atmospheric pressure. Gasoline, or any other fuel which is kept in an adjacent float chamber, is forced from this chamber through an appropriate nozzle or jet into the Venturi throat as a result of the difference between the atmospheric pressure and the static pressure of the air flowing through the Venturi throat. For normal driving, the air/fuel ratio should be about 15 to 1 by weight. This ratio may be generally achieved by properly sizing the Venturi throat and fuel nozzle.

Functionally, the carburetor parts may be classified as:

1. means for metering the fuel into a variable air flow to obtain the desired air/fuel ratio;
2. a regulated pressure supply of fuel to the metering means;
3. means for varying the flow of the air/fuel mixture to meet variable demand power; and
4. auxiliary means to provide perfection of smooth idling.

Many prior art carburetors use a "butterfly" valve to impose a controlled variable pressure drop between the carburetor and the engine cylinders for controlling power or speed. Between the source of fuel, i.e., the fuel tank, and the Venturi throat of the carburetor, the metering means usually consist of a float controlled valve arranged to maintain a steady level in the float chamber. However, the task of precisely metering fuel into the air is a difficult one at best. Thus, a major compromise in many contemporary carburetors is the metering system since this system may be subject to fault of surge and splash and disruption of the desired level of the fuel if the carburetor is not maintained horizontal, or if it is subject to severe acceleration.

Thus, a need exists for a carburetor having an improved metering system to increase the efficiency thereof.

In addiion, in view of the acknowledged decrease in the supply of fossil fuel available today, it is important to increase the efficiency of the carburetor as much as possible. Another way of increasing the efficiency of the carburetor is by more completely atomizing the fuel prior to mixture with the air flow through the carburetor. Most carburetors secure atomization and vaporization by the use of low pressure spray of the fuel into the moving air stream. This may not be maximally efficient.

Thus, there is a need for additionally increasing the efficiency of the carburetion scheme utilized with most internal combustion engines manufactured today by more effectively causing the atomization of the fuel supplied therein.

Accordingly, it is an object of the present invention to provide an improved apparatus for collecting, mixing, and metering the discharge of a fluid supplied thereto.

Another object of the present invention is to provide an improved dispensing apparatus for dispensing a fluid collected therein.

Still another object of the present invention is to provide an improved fluid dispensing apparatus such as a lawn water sprinkler, or the like.

A further object of the present invention is to provide an improved carburetor and the like.

A still further object of the present invention is to provide a carburetor having an improved fuel metering and atomizing system.

SUMMARY OF THE INVENTION

In accordance with the above and other objects, there is provided a liquid collecting and dispensing apparatus including a hollow chamber formed of a pair of half sections, wherein one of said half sections includes metering means adjustably disposed within a portion of the other. The one section is selectively moved into and out of the other section thereby forming a variable valve collar therebetween. A hollow shaft is provided to input fluid into the hollow chamber with metering means comprising apertures disposed in the valve collar. By moving the sections with respect to one another, the length of the valve collar is varied which in turn varies the effective size of each aperture, thereby metering the outflow of liquid from the chamber.

In one feature of the invention, the hollow shaft is rotated whereby the centrifugal force aids in the discharge of liquid from the chamber.

The apparatus of the present invention is suitable to be utilized as a carburetor for atomizing fuel supplied thereto through the hollow shaft while metering the fuel outflow into the air passing through a main carburetor body in which the apparatus is operatively disposed to thereby provide a fuel/air combustible mixture. One aspect of the invention is that the rotation of the hollow shaft more effectively atomizes the fuel as it is metered into the air to increase the air/fuel mixture ratio and to produce a better combustion mixture over some prior art carburetors.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 1 is a partial cross-sectional and cut-away view of a fuel collecting and dispensing apparatus comprising a carburetor mechanism of one embodiment of the present invention;

FIG. 2 is an enlarged cross-sectional view illustrating the idle adjustment mechanism shown within the dash-circled 2 of the carburetor of FIG. 1;

FIG. 3 is an enlarged cross-sectional view of the idle jet portion of the carburetor of the present invention taken in the directions of arrows 3—3 in FIG. 2;

FIG. 4 is an enlarged cross-sectional view of one rotor bearing of the carburetor of the present invention taken along the directions of arrows 4—4 in FIG. 1;

FIG. 5 is a perspective view illustrating the two halves of a liquid dispensing apparatus of a second embodiment of the invention, for instance, a water sprinkling device or the like;

DESCRIPTION OF THE PREFERRED EMBODIMENTS

Figure 6:
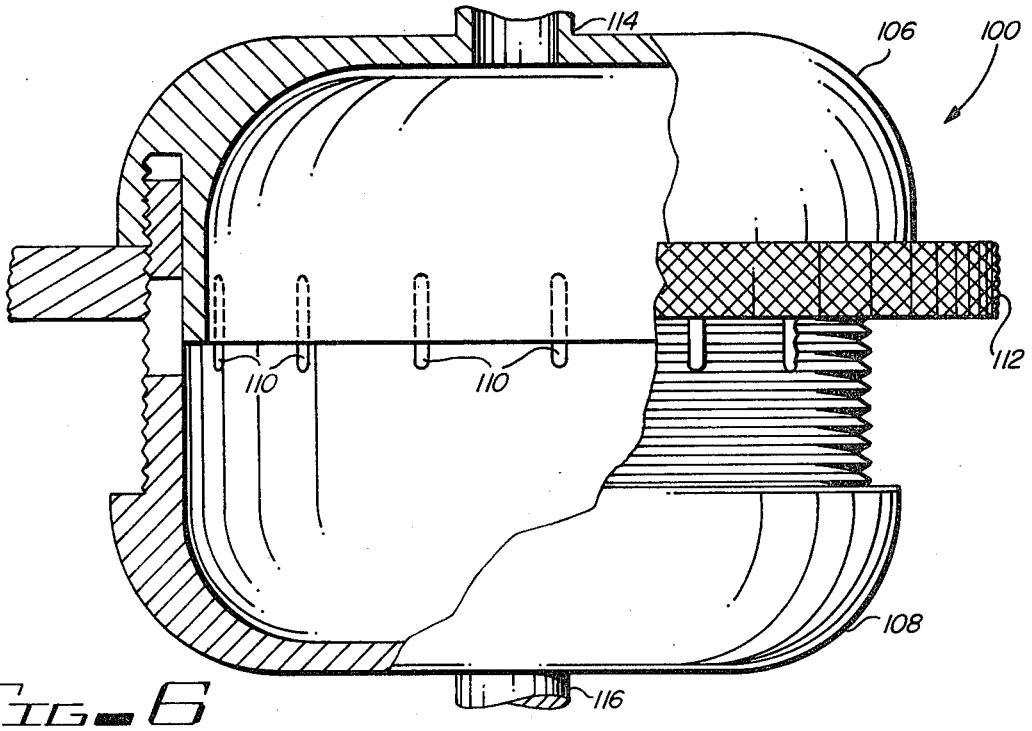
FIG. 6 is an enlarged partial cut-away and elevation view of the device of FIG. 5.

Referring to FIGS. 1–4, there is illustrated a liquid dispensing apparatus of one embodiment of the present invention. As will become apparent, the aforementioned apparatus is suited for use as a carburetor, or the like, to provide a combustible air/fuel mixture to the cylinders of an internal combustion engine. Carburetor 10 of the figures includes a main carburetor body 12 in which a fuel collecting hollow chamber 14 is disposed. Chamber 14 comprises an upper half 16 and lower half 18 of hollow cylindrical shape configuration. Each half has a respective shoulder 20 and 22 formed about the outer facing surface thereof.

As particularly shown in FIG. 2, upper half 16 has a circular groove 26 cut in the wall thereof which is suited to receive a portion of sleeve 28 of lower half 18 to form a variable length valve collar 24. A plurality of elongate apertures, or jets, 30 are disposed about the circumference of sleeve 28. The halves are held apart in the idle position by an idle adjustment screw 33 that is threaded through the shoulder 20 of upper half 16 and rests against shoulder 22 of lower half 18. Threaded screw 32, is shown as including head 33 which allows a user to set the minimum distance at which the two halves are separated to allow minimal fuel discharge from the carburetor to operate the internal combustion engine coupled thereto in an idle mode. A lock nut 34 is provided to maintain the opening between the two halves at the idle set position. In the idle position, jets 30 are partially exposed to the interior of body 12. By adjustment of screw 32, the opening size of jets 30 can be increased or decreased to allow more or less fuel to be discharged from chamber 14 as more or less of each of the metering jets is exposed to the interior of carburetor body 12.

Hollow chamber 14 includes a hollow shaft 36 integrally formed therewith, that is, rotatably mounted through rotor bearing 38. Rotor bearing 38 is mounted in wall 40 of carburetor body 12. Shaft 36 provides an opening into chamber 14 through which fuel is supplied to fill the chamber. Fuel is supplied from a main source, such as a fuel tank, and may be pumped to carburetor 12 by use of a conventional fuel pump. A flexible hose 41 is connected through swivel connector 42 to hollow shaft 36 through which the fuel passes.

Chamber 14 is rotatably affixed to bottom rotor bearing 44 which has a spider-like shape as illustrated in FIG. 4. Rotor bearing 44 is shown as including bearing 45 and a plurality of blades or spokes 46. Rotor bearing 44 is fixedly mounted in wall 46 of body 12. Thus, chamber 14 can be either held stationary or rotated within body 13 of carburetor 10.

As indicated in a preferred embodiment, an electric motor 48 is provided that is connected by a pulley assembly 50 to pulley gear 52 mounted on shaft 36. It is to be understood then that instead of pulley 50, motor 48 could be directly geared to shaft 36. A compression spring 54 extends between the upper half 16 of chamber 14 and flange member 56 of shaft 36. Shaft 36 also includes collar 58 connected to a throttle linkage 60 which is utilized to raise or lower separable upper half 16 with respect to lower half 18 to thereby control the metering fluid outflow from chamber 14.

In operation, carburetor 10 may be connected to each cylinder of the engine through a manifold assembly that would be connected to wall 46 or individual carburetors could be used at each cylinder. As fuel is pumped into chamber 14, it is collected. The fuel is either evacuated through jets 30 by pump pressure, or if motor 48 is activated, by centrifugal force in conjunction with the pump pressure into the interior of carburetor body 12. By spinning chamber 14, the high centrifugal velocity effectively atomizes and vaporizes the fuel exiting the metering jets 30 with the inflow of air passing through bearing assembly 38 located at the top of body 12 to provide the correct air/fuel ratio combustible mixture. This mixture exits carburetor 10 through bearing assembly 44 to enter the individual cylinders of the engine. During acceleration and at higher vehicle velocities, throttle linkage 60 causes separation of the two halves of chamber 14 thereby increasing the effective size of apertures 30 to allow more fuel to be mixed with incoming air flow to provide the necessary air/fuel ratio to sustain higher engine rpms.

Rotor bearing assembly 38 may be formed so that it is rotated by motor 48 to supercharge the air inflow into the carburetor body 12 to increase the efficiency of carburetor 10. Also, it should be understood that the speed of motor 48 could be varied by means of a speed control (rheostat) that, in conjunction with variable pulley ratios, could drive the shaft at different speeds and even to allow rotor bearing 38 to be driven at different speeds than chamber 14.

Further, it is to be understood that although shaft 36 is illustrated as being driven by a separate electric motor, any suitable means for rotating the shaft could be employed. For example, a shaft and the chamber could be rotated by a vacuum or exhaust system, or from the camshaft which is normally utilized to drive the distributor of the vehicle.

Thus, what has been described above is a carburetor including a chamber for collecting and metering fuel outflow whereby more precise air/fuel ratios may be maintained to increase the fuel efficiency of today's internal combustion engine operated vehicles. The carburetor of the invention replaces the need for idle and main jets utilized in most contemporary carburetors. Additionally, the carburetor of the present invention can be utilized to accept one or more fuel or fluids singly or simultaneously into the chamber thereof and in either a cool or heated state to be combined and mixed therein and then metered into the carburetor body.

Turning now to FIGS. 5–6, there is shown a fluid collecting and metering dispensing apparatus of another embodiment of the present invention which includes a hollow chamber 100 suited for collecting and dispensing the fluid passed thereto. Chamber 100 is comprised of two hollow halves 102 and 104, each having a respective extending sleeve 106 and 108. Female sleeve portion 106 is threaded to receive male threaded sleeve 108 which, when mated, forms a valve collar having a variable expandable length. A plurality of elongate fluid metering apertures 110 are provided around the circumference of sleeve 108. By threading sleeve 108 into a portion of sleeve 106, the effective aperture size of each aperture 110 can be varied from a fully opened position to a fully closed position. A locking nut 112 is provided for securing the two halves at any desired metering aperture size.

A hollow shaft 114 is provided which allows fluid, for example water, to pass into the hollow cavity formed by the two halves of chamber 100 whereby the fluid is collected before being metered out of apertures 110 either by the force of the water pressure or by rotation of chamber 100 or in a combination of both.

As illustrated in FIG. 6, halves 106 and 108 are secured in a predetermined position by locking nut 112 to allow a predetermined amount of fluid passing into and collected in the cavity of chamber 100 through shaft 114 to be metered through apertures 110. As shown, an additional hollow shaft 116 may be provided to allow fluid to pass from chamber 100, for example, to allow an additional chamber identical with chamber 100 to be coupled in series therewith.

Figure 11:
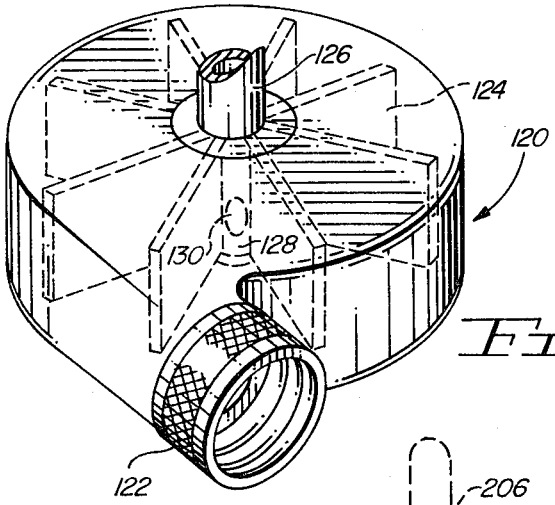
FIG. 11 is a perspective view of an adaptor mechanism for deflecting liquid supplied thereto to the devices of FIGS. 6 and 7.

If, as an example, chamber 100 is to be utilized as a lawn sprinkler, an adaptor 120 (FIG. 11) may be provided for permitting water to pass through the chamber while causing rotation thereof such that an effective lawn service can be watered. Otherwise, a source of water could be supplied directly to shaft 114 of chamber 100, for instance to produce a water bubbler effect. Adaptor 120 includes a coupler assembly 122 for connecting to the water source, i.e., a garden hose or faucet. Adapter 120 comprises a hollow cavity into which the water under pressure flows. A paddle wheel assembly 124 is rotatably mounted within the cavity of adaptor 120 and which is caused to turn by the water entering the cavity. This, in turn, causes hollow shaft 126, which is fixedly mounted to paddle wheel assembly 124, to rotate. Additionally, the paddle wheel assembly 124 includes a hollow inner shaft 128 having an aperture 130 located therein through which the water flows therethrough into hollow shaft 126. Hence, if shaft 126 is connected with or forms the shaft 114 of chamber 100, chamber 100 is filled with water while being caused to be rotated thereby allowing the water to be spread a predetermined distance as it exits the metering apertures.

Figure 8:
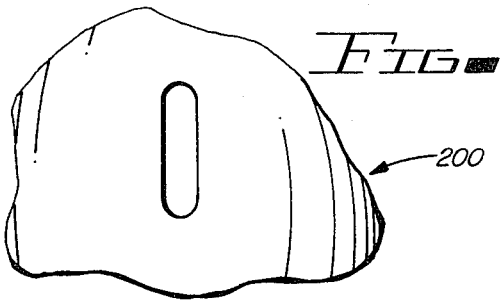
FIG. 8 is an enlarged view of a fully opened liquid metering outlet of the device of FIG. 7.
Figure 7:
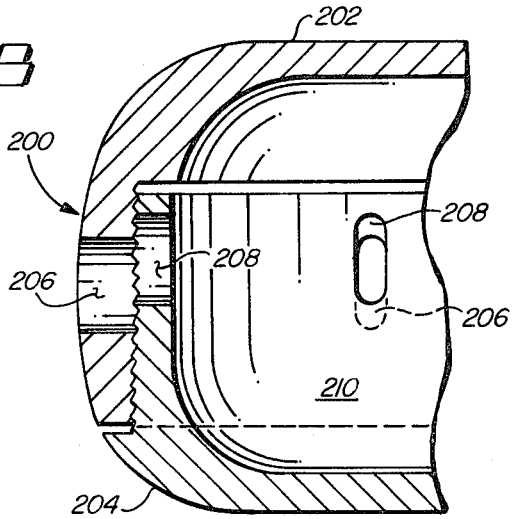
FIG. 7 is a partial cross-sectional view of a water sprinkling device, or the like, of another embodiment of the present invention.
Figure 9:
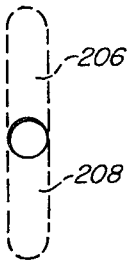
FIG. 9 is a schematic representation showing a liquid metering outlet of the device of FIG. 7 that is adjusted for minimal liquid dispersion.
Figure 10:
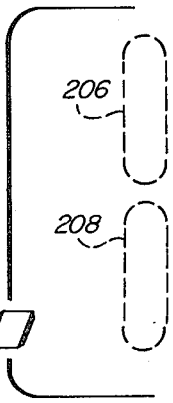
FIG. 10 is a schematic representation illustrating one of the liquid outlets or jets of FIG. 7 which is in a fully closed position.

Turning to the remaining figures, there is illustrated an additional embodiment of the fluid dispensing apparatus discussed above with respect to FIG. 6. In this embodiment, a chamber 200 is provided consisting of two hollow halves 202 and 204 which form a valve collar in the same manner as previously discussed. As shown, upper half 202 also includes a plurality of apertures 206 formed therethrough which coincide with respective apertures 208 of lower half 204. By threading lower half 204 all the way inside upper half 202, the chamber 200 is in a fully closed position (FIG. 10) whereby fluid cannot be evacuated from collecting chamber 200. Likewise, by backthreading half 204, the effective size of metering apertures can be varried from a minimal opening (FIG. 9) to a fully opened position (FIG. 8). Thus, water flowing into cavity 210 through a hollow shaft as aforedescribed will be metered out by flowing through apertures 208 and 206 which are aligned to the outside atmosphere. As previously described, chamber 200 can be connected to adaptor 120 to be rotated whereby the centrifugal force is utilized to force the fluid of cavity 210.

One aspect of the water sprinkler described above is that one or more fluids can be singly, or in combination, simultaneously be mixed within the cavity of the chamber. Thus, for instance, a liquid fertilizer could be mixed with the water entering the chamber to provide simultaneous fertilization and watering of a lawn.

While the invention has been particularly shown and described in reference to the preferred embodiments thereof, it will be understood by those skilled in the art that changes in the form and details may be made without departing from the spirit and scope of the invention as defined by the attached claims. To the extent that such changes in form and details do not depart from the spirit of the invention, they are intended to be included within the scope thereof which is assessed only by a fair interpretation of the following claims.

Having fully described and disclosed the present invention in such clear and concise terms as to enable those skilled in the art to understand and practice the same, the invention claimed is:

1. A liquid collecting and dispensing apparatus, comprising:

means for collecting the liquid including first and second halves, said second half being adjustably disposed within a portion of said first half to form a hollow chamber and valve collar therebetween;

means for inputting the liquid into said chamber comprising hollow shaft means;

a plurality of apertures formed in said valve collar the effective openings of which are varied by adjusting said first and second halves with respect to one another, said plurality of apertures for metering the discharge of the liquid from said chambers;

an electric motor;

pulley drive means coupling said electric motor to said hollow shaft means for rotating said first and second halves; and means for selectively moving said first and second halves with respect to one another to vary the amount of liquid that is dispensed from the apparatus, said means for selectively moving including a collar coupled with said hollow shaft; a flanged member coupled with said hollow shaft; a spring connected between said flanged member and said first half; and linkage means coupled with said collar for raising and lowering said hollow shaft, said hollow shaft being slidably mounted within a main assembly structure to which said second half section is fixedly mounted.

2. The apparatus of claim 1 wherein said inputting means includes a hollow shaft formed integrally through said chamber which is adapted to be coupled with a source of the liquid through which the liquid passes.

3. The apparatus of claim 1 wherein said second half includes a sleeve portion adjustable disposed within said first half for forming said valve collar and having said apertures formed thereabout.

4. A carburetor for atomizing and vaporizing fuel mixed with air to form an explosive mixture, comprising:

a main body member through which air passes;

a hollow chamber through which fuel is passed which includes first and second halves each having cylindrical cross-sections, said first and second halves being slidably in contact with respect to each other to form a valve collar therebetween, said first half including a groove circularly disposed therein and a shoulder member extending thereabout, said second half including a circular sleeve member extending therefrom and a shoulder member extending thereabout, said sleeve member being slidably disposed within said groove in said first half and forming therewith said valve collar;

means for inputting the fuel into said hollow chamber;

means for metering the outflow of the fuel from said valve collar;

means for moving said first and second halves with respect to each other to vary the amount of contact therebetween such that the outflow of fuel from said valve collar is varied;

idle adjust means for causing a minimum of fuel to be metered from said valve collar whenever fuel is inputted to said hollow chamber;

rotary drive means; and rotary drive coupling means coupling said rotary drive means with said first and second half for causing the same to be rotated wherein the fuel is atomized as it exits said valve collar.

5. The carburetor of claim 4 wherein:

said metering means includes a plurality of apertures disposed in said sleeve member of said second half wherein the effective size thereof is varied as said first and second halves are moved with respect to each other; and said idle adjust means includes a screw mounted in contact between said respective shoulders of said first and second halves for maintaining said first and second halves a minimum amount apart from one another whereby minimal fuel outflows from said metering means.

6. The carburetor of claim 5 wherein said inputting means includes a hollow shaft integrally formed with and through said first half and being coupled to a source of the fuel such that said fuel passes therethrough into said hollow chamber as fuel is supplied to the carburetor, said hollow shaft being coupled wih said rotary drive coupling means.

7. The carburetor of claim 6 wherein:

said hollow shaft being rotatably disposed through said main body member; and said second half of said chamber being rotatably fixed to said main body member whereby said chamber is caused to be rotated by said rotary drive means.

* * * * *